US009336665B2

(12) United States Patent
Yang

(10) Patent No.: US 9,336,665 B2
(45) Date of Patent: May 10, 2016

(54) EAS TAG WITH ARMING SWITCH

(75) Inventor: Xiao Hui Yang, Saratoga, CA (US)

(73) Assignee: WG Security Products, Campbell, CA (US)

( * ) Notice: Subject to any disclaimer, the term of this patent is extended or adjusted under 35 U.S.C. 154(b) by 812 days.

(21) Appl. No.: 13/370,639

(22) Filed: Feb. 10, 2012

(65) Prior Publication Data

US 2012/0206263 A1 Aug. 16, 2012

Related U.S. Application Data

(60) Provisional application No. 61/441,353, filed on Feb. 10, 2011.

(51) Int. Cl.
*G08B 13/14* (2006.01)
*G08B 3/10* (2006.01)

(52) U.S. Cl.
CPC . *G08B 13/14* (2013.01); *G08B 3/10* (2013.01)

(58) Field of Classification Search
CPC ..... E05B 73/0017; E05B 39/002; E05B 73/0005; G08B 13/2431; G08B 13/2434; G08B 13/2468; G08B 15/02
See application file for complete search history.

(56) References Cited

U.S. PATENT DOCUMENTS 3,708,835 A 1/1973 Bienz
4,196,424 A 4/1980 Williamson
4,263,697 A 4/1981 Speedie
4,441,233 A 4/1984 Swift
4,506,415 A 3/1985 Swift
5,337,503 A 8/1994 Goby
5,524,463 A 6/1996 Schenkel et al.
5,568,951 A 10/1996 Morgan
5,570,080 A 10/1996 Inoue
5,627,520 A 5/1997 Grubbs et al.
5,717,382 A 2/1998 Cooper
5,841,349 A * 11/1998 Holmgren ..... E05B 73/0017 340/572.1
5,856,782 A 1/1999 Sasagawa et al.
5,945,909 A 8/1999 Kolton
5,949,336 A 9/1999 Deschenes et al.
5,959,532 A 9/1999 Fujiuchi
5,969,613 A 10/1999 Yeager et al.
5,995,003 A 11/1999 Rogers
6,025,781 A 2/2000 Deschenes
6,052,876 A 4/2000 Hogan et al.
6,188,320 B1 2/2001 Kolton et al.
6,326,890 B1 12/2001 Costa
6,535,130 B2 3/2003 Nguyen et al.
6,624,753 B2 9/2003 Elston
6,724,311 B1 4/2004 Kolton et al.

(Continued)

*Primary Examiner* — Kerri McNally
*Assistant Examiner* — Renee Dorsey
(74) *Attorney, Agent, or Firm* — Robert R. Waters; Brian W. Foxworthy; Waters Law Group

(57) ABSTRACT

An EAS tag has an arming switch protruding from its body to detect when the EAS tag is being forcibly removed from an object to which it is attached. A plate covers the arming switch to provide a broader surface for interacting with the attached object. The plate is capable of floating and moving when it is impinged upon by an attached object. When moved by an object when the EAS tag is attached to an object, the plate actuates the arming switch and changes its state. This can arm the EAS tag or can be a step in the arming process of the EAS tag. When the EAS tag is forcibly removed from an object, the plate and arming switch are released, and electronics onboard the EAS tag determine an alarm condition.

21 Claims, 7 Drawing Sheets

(56) References Cited

U.S. PATENT DOCUMENTS

| | | | | |
|---|---|---|---|---|
| 6,731,212 | B2 | 5/2004 | Hirose | |
| D493,739 | S | 8/2004 | Copen | |
| D494,487 | S | 8/2004 | Sayegh | |
| D502,419 | S | 3/2005 | Copen | |
| D503,900 | S | 4/2005 | Sayegh | |
| D504,634 | S | 5/2005 | Sayegh | |
| D505,349 | S | 5/2005 | Sayegh | |
| 6,933,847 | B2 | 8/2005 | Feibelman | |
| D509,454 | S | 9/2005 | Sayegh | |
| 7,005,989 | B2 | 2/2006 | Benoit et al. | |
| 7,062,823 | B2 | 6/2006 | Copen | |
| 7,148,805 | B2 | 12/2006 | Hogan | |
| 7,183,914 | B2 | 2/2007 | Norman et al. | |
| 7,227,467 | B2 | 6/2007 | Feibelman | |
| 7,249,401 | B2 | 7/2007 | Copen et al. | |
| 7,286,055 | B2 | 10/2007 | Girvin et al. | |
| 7,342,494 | B2 | 3/2008 | Maloney | |
| D566,598 | S | 4/2008 | Sayegh | |
| D567,128 | S | 4/2008 | Sayegh | |
| D578,030 | S | 10/2008 | Yang et al. | |
| 7,518,521 | B2 | 4/2009 | Feibelman et al. | |
| 7,595,733 | B2 | 9/2009 | Spagna | |
| 7,626,501 | B2 | 12/2009 | Feibelman | |
| 7,671,741 | B2 | 3/2010 | Lax et al. | |
| 7,724,146 | B2 | 5/2010 | Nguyen et al. | |
| 7,808,390 | B2 | 10/2010 | Sayegh | |
| 7,969,310 | B2 | 6/2011 | Sayegh | |
| 2009/0058659 | A1* | 3/2009 | Handyside et al. | 340/572.9 |
| 2010/0308998 | A1* | 12/2010 | Hesch et al. | 340/572.8 |
| 2010/0315237 | A1 | 12/2010 | Yang | |
| 2010/0315238 | A1 | 12/2010 | Yang | |
| 2010/0315239 | A1 | 12/2010 | Yang | |
| 2011/0115632 | A1 | 5/2011 | Yang | |
| 2011/0227706 | A1 | 9/2011 | Yang | |
| 2011/0260594 | A1 | 10/2011 | Yang | |
| 2011/0273295 | A1* | 11/2011 | Sayegh et al. | 340/572.1 |

* cited by examiner

EAS TAG WITH ARMING SWITCH

CROSS REFERENCE TO RELATED APPLICATIONS

This application claims priority from U.S. Provisional Application 61/441,353, filed on Feb. 10, 2011. The teachings in the specification for the provisional application are incorporated herein by reference.

FIELD OF INVENTION

The present application is generally related to electronic article surveillance (EAS) tags that are attached to objects to be monitored, and more specifically, to EAS tags that have arming switches that provide an arming condition when the tags are attached to objects to be monitored. Also, the tags of the present application may be used with various electronic article surveillance (EAS) systems, including for example, an EAS system utilizing tags and deactivators featuring infrared communication for deactivation and alarming, and featuring dynamic time-based passcode modification, and other tamper resistant features.

BACKGROUND OF THE INVENTION

Electronic article surveillance systems have been used for many years as a means of deterring retail shoplifting in clothing stores, electronic stores, and a myriad of other retail establishments. Generally speaking, an EAS system will begin with a tag, consisting of a durable and reliable, yet small, sensor tag which is affixed to the article to be detected in such a way that it cannot be easily removed by a customer in the store. Usually, the system depends upon the feature that the attachment mechanism is constructed such that it can only be removed by the use of a specialized tool which is only in the possession of an authorized store personnel at the check-out register or exit port for the establishment. In the event that an EAS tag is not removed from a protected article prior to exiting the store, an alarm or other signal is activated.

In many commercially available EAS systems, one or more antennas are placed at the exits and entrances to the retail location. These antennas set up zones, sometimes referred to as interrogation zones, in which an EAS tag (or marker) may be sensed. At least one antenna serves the function of sending out what is called an interrogation signal. The markers on the merchandise are affected by this signal and will respond with a signal of their own. Either the same antenna that sends out the interrogation signal or other additional antennas can sense the signals from the markers. The most effective way to do this is by stopping the broadcast of the interrogation signal to listen for the signals emanating from the markers. If a marker is sensed within the zone created by the antennas, it is presumed that an article is being removed without purchase, and alarms are set off. These alarms may be audible alarms for general broadcast or the alarms may be silent alarms in the form of a light at a check-out counter or security station, etc. Additionally, some EAS tags have onboard audible alarm generators and can generate audible alarms by themselves. These tags may produce this audible alarm when onboard logic elements determine that the tag being removed from the store, or when the larger EAS system communicates to the tag to alarm. The onboard logic elements and the larger EAS system may also cause the tag to cease to alarm under certain situations.

In order to make an EAS system effective, one must consider how to make the EAS tags tamper resistant. This is an on-going effort, because over time, thieves become more capable in learning how to defeat an EAS tag. The retailer (and the tag manufacturer) must consider how to detect and prevent tampering with the tags. The particular construction of a tag will determine how tampering is detected.

An assortment of attachment mechanisms are available in the prior art. One of the more common and more successful attachment mechanisms is an EAS hard tag, consisting of a tack which is used to physically pin the EAS tag base to the protected article. The tag base is usually constructed of a hard and durable plastic and is generally in the neighborhood of three inches long. The tag serves as a housing for an electronic signal generation means secured within the housing, and which is designed to be immune to tampering. A cap on the tack keeps the tag attached to the article.

Another common and successful method of attaching tags, or transponders, is a lanyard. One end of the lanyard is fixed in the transponder and the other end is capable of being inserted into an aperture in the transponder where it can be retained by the transponder. The lanyard can pass through an aperture on the article to be protected or may be placed around an article in a position where it cannot be simply slid off the article. The lanyard is typically constructed of material that is very difficult to break or cut, but yet, is easy to bend into place. A variation on lanyard tags passes the unfixed end of the lanyard through the body of its tag to form a loop which may be adjusted onto an object by pulling the unfixed end. A clutch in the body prevents the lanyard loop from being enlarged unless the clutch is release by an authorized person. Some tags may form more than one loop.

A common device for releasably retaining both tack shafts and lanyards is a ball clutch mechanism. The ball clutch mechanism may be constructed to release the retained item after application of a magnetic force to the tag. Other clips and clamps may also be used. Other types of tags may employ vials of ink, which may break if the tag is physically bent, thereby destroying the benefit of the theft attempt.

While tack, lanyard, and other types of tags have found wide use in protecting objects, they must remain attached to a given object to protect it. A common manner of defeating an EAS tag is to forcibly remove the tag from the object being protected. A countermeasure employed with some EAS tags is the introduction of a switch which has its state changed and arms the tag when a tag is attached to an object to be protected. This switch is often termed a plunger switch. The actuated part of the switch is a small plunger that extends from the tag at location where the object and tag interact. For example, in tags employing a tack, a switch is positioned on the tag at a location beneath the head of the tack. When the tack is inserted through an object, the object and the head of the tack bear upon the switch and change its state.

Associated devices may communicate with electronics within the EAS tag to add an additional step to the tag arming process. When the tag is attached to an object and the state of the switch changed, this change of state functions as confirmation that the tag is attached, and an authorized person can use an associated device to wirelessly communicate with the tag to complete the tag installation and arming process. Once armed, if a tag is forcibly removed, the switch's state again changes, and the electronics of the EAS tag determine that an alarm condition exists. The EAS tag can sound an audible alarm with an onboard audible alarm generator or wirelessly communicate an alarm to other elements of the EAS system.

Although the presence of a plunger switch can aid the ability to detect when a tag is attached to an object, the switch may not operate consistently. For example, if a tag is attached to an article of clothing, the plunger of the switch may merely protrude into the clothing and the state of the switch may not change. Alternatively, the tag may install properly, but with handling of the clothing, the plunger may move and change the state of the switch, causing a false alarm; a very undesirable occurrence. In other situations, the objects may be too irregularly shaped to guarantee contact with the plunger. If a recess in an irregularly shaped object coincides with the location of the switch, the switch will not detect the presence of the object, and the tag will fail to arm. Alternatively, a tag may be successfully attached to an irregular object and armed, but a small shift of the object may release the switch, which would cause the undesired false alarm. Embodiments of the present invention can work with the several prior art embodiments of EAS tags employing plunger switches to counter the deficiencies discussed above.

SUMMARY

This application generally discloses a more reliable switch mechanism for EAS tags employing switches as part of the arming process when an EAS tag is attached to an object to be protected. The switch mechanisms in the various embodiments of the invention employ a plate with the switch so that a broader surface area is presented to contact the object being protected. This provides for more reliable operation of the switch and EAS tag. The plate attaches to the body of the tag and covers the switch and may be shaped for a particular application. This more reliable switch mechanism can be adapted to a broad range of EAS tag shapes as well as the several different types of EAS tags and system combinations.

A person of ordinary skill in the art would understand how to incorporate the improvements described herein into a conventional EAS system.

BRIEF DESCRIPTION OF THE DRAWINGS

Additional utility and features of the invention will become more fully apparent to those skilled in the art by reference to the following drawings, which illustrate some of the primary features of preferred embodiments.

DESCRIPTION OF THE EMBODIMENT(S)

Figure 1:
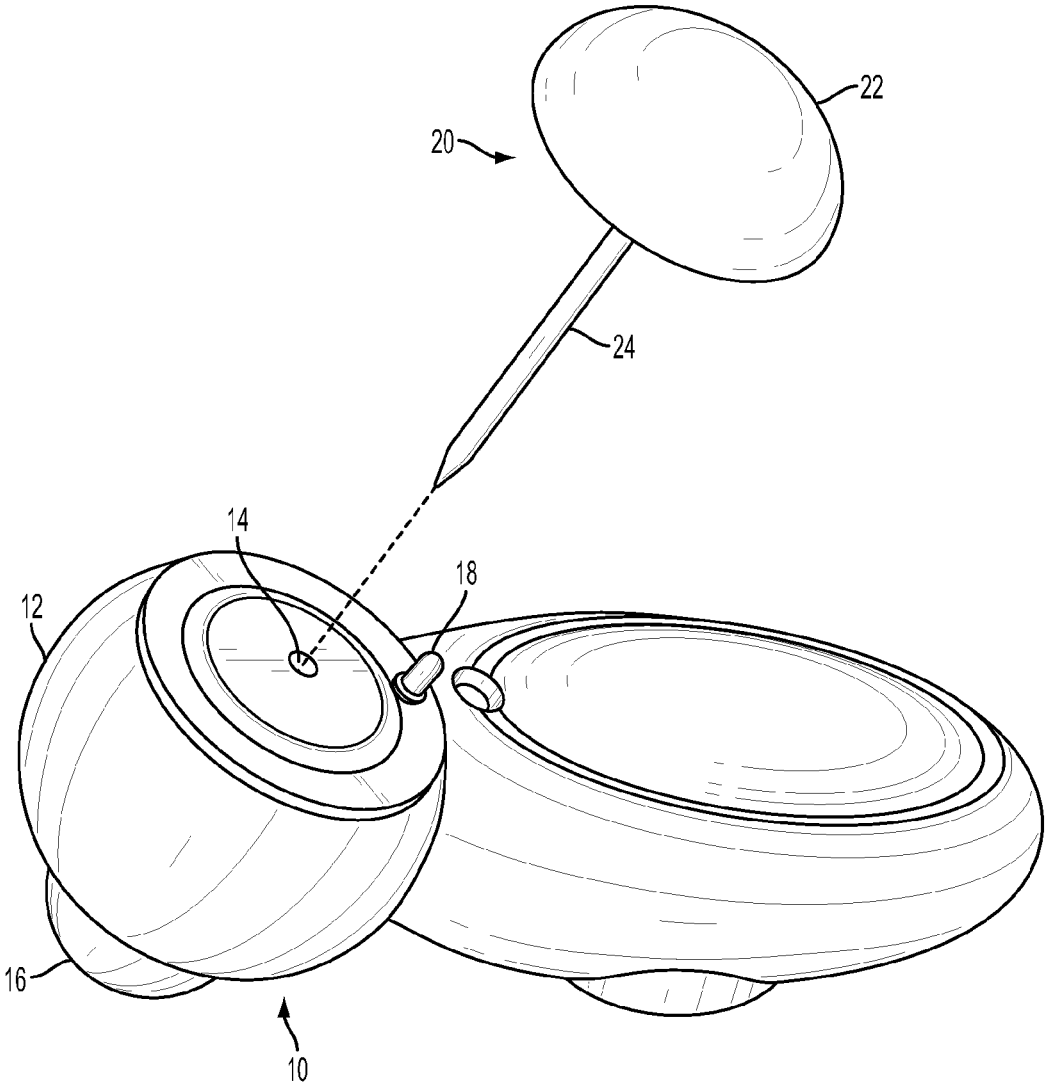
FIG. 1 PRIOR ART
FIG. 1 is a perspective view of a prior art EAS tag employing a bare arming switch as part of the arming process.

FIG. 1 is a perspective view of a prior art EAS tag employing a bare arming switch as part of the arming process. EAS tag 10 is used in conjunction with tack 20. EAS tag 10 has a body 12 with an aperture 14 in it. Tack 20 has a cap 22 and a shaft 24 extending from cap 22. To attach tag 10 to an article to be protected, shaft 24 of tack 20 is passed through the article to be protected and inserted in aperture 14 in tag 10. A clutch contained within body 12 of tag 10 prevents shaft 24 from being withdrawn from tag 10 without the release of the clutch, usually by an authorized person using a special device made specifically for that purpose. Frequently, this special device is capable of generating a magnetic force and is applied to tag 10 at a specific location, such as dome 16 of tag 10, to release the clutch.

Tag 10 contains electronics within its body 12 and there may be several security systems and methods by which these electronics enable a tag and its associated protected article to be detected passing from a protected area, such as a retail store. Some systems employ passive EAS elements which are energized by interrogation fields generated at exits and other control points. The energized passive EAS elements generate signals which can be detected by the EAS systems, which generate alarms when it is determined that a tag is illicitly exiting a store. Other EAS systems utilize EAS tags with more sophisticated electronics on board which include microprocessors, communication elements, audible alarm generators, and other electronic elements. These more sophisticated EAS tags can store information, execute logic, and communicate with the broader EAS system. These tags may also utilize passive EAS elements.

One of the ways in which these security systems may be defeated is by forcibly removing an EAS tag from the article to which it is attached. The tag is left behind and the article may then be removed from the area without fear of electronic detection. In the prior art EAS tag 10 shown in FIG. 1, tag 10 may be forcibly removed from an article by overcoming the clutch holding shaft 24 of tack 20 or by breaking cap 22 of tack 20 from shaft 24.

Tag 10 shown in FIG. 1 has one of the countermeasures employed to thwart this approach to defeating the security systems. Arming switch 18 protrudes from body 12 of tag 10. Arming switch 18 is located in the area of body 12 covered by cap 22 of tack 20 when shaft 24 is inserted to attach tag 10 to an object. When cap 22 of tack 20 is pushed down and brings an article to be protected in contact with tag 10, cap 22 and the article move arming switch 18 and change its state. This by itself may arm tag 10, or it may be an initial condition that allows the arming of tag 10. In the latter case, another element of the overall EAS system may communicate with tag 10 to complete the arming of tag 10. This can be accomplished by communication through exposed contacts on tag 10 or through wireless communication. If through exposed contacts, another device must contact tag 10 at the contacts to establish communication. The wireless communication may be via optical communication such as infrared communication, or by other wireless communication such as radio frequency communication.

Once tag 10 is armed, if arming switch 18 is released without tag 10 being disarmed, the electronics of tag 10 determine an alarm condition and can generate an alarm. This alarm may be an audible alarm generated by an onboard audible alarm generator or it may be an alarm communicated to the overall EAS system via wireless communication. Arming switch 18 may be released by the forcible removal of shaft 24 from the clutch in body 12 of tag 10 or by breaking cap 22 from shaft 24. Tag 10 may be disarmed by the same devices that are used to arm it when it is attached to an object to be protected.

While arming switch 18 is an effective countermeasure against forced removal of EAS tag 10 from an object, it can be improved. As may be seen in FIG. 1, the part of arming switch 18 that protrudes from body 12 of tag 10 is relatively narrow. For certain items such as cloth items, it is possible that arming switch 18 may simply pass through the cloth. For example, arming switch 18 might simply pass through a sweater. In other situations, if shaft 24 is passed through a hole, such as a buttonhole, arming switch 18 may also align with the hole. Alternatively, arming switch 18 may be effective enough to allow tag 10 to be initially armed, but may later change its state with jostling of the object to which it is attached. This would lead to a false alarm which is a very undesirable result.

Figure 2:
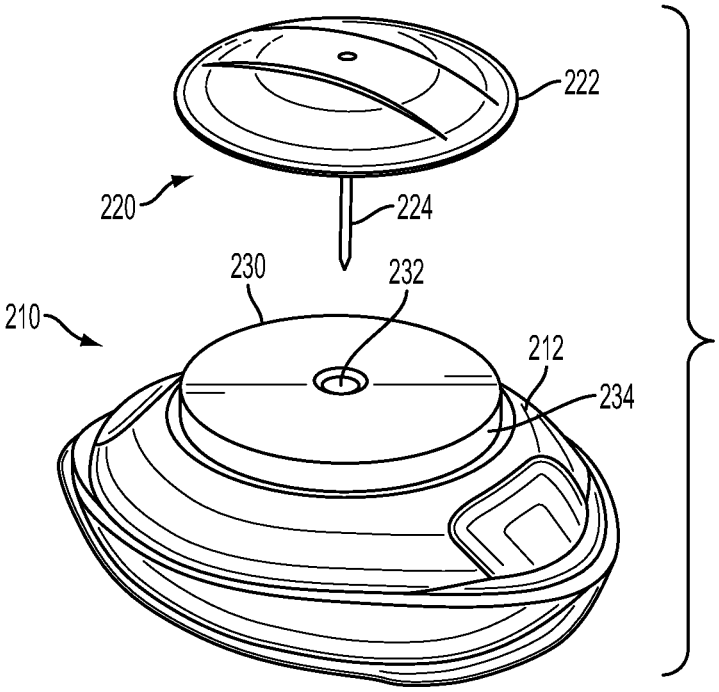
FIG. 2 is a perspective view of an EAS tag having an embodiment of a switch mechanism employing a plate.

By improving the reliability of arming switch 18, an improvement may be made in EAS tags employing such a countermeasure as arming switch 18. FIG. 2 is a perspective view of an EAS tag having an embodiment of a switch mechanism employing a plate. EAS tag 210 has a body 212 with an aperture 214 in it for receiving shaft 224 of tack 220 similar to that of the prior art EAS tag 10 of FIG. 1. However, EAS tag 210 has a plate 230 with aperture 232 mounted on it. Aperture 232 of plate 230 aligns with aperture 214 of EAS tag 210, and when shaft 224 of tack 220 is inserted into aperture 214 of EAS tag 10, shaft 224 also passes through aperture 232 of plate 230. Inside body 212 of EAS tag 210 is a clutch which engages shaft 224 and prevents its retraction, unless the clutch is disengaged. In some embodiments, this may be accomplished by application of a magnetic force to a particular area of body 212. When EAS tag 210 is assembled to an object to be protected by passing shaft 224 through the object and into aperture 214 of EAS tag 210, the object is captured between cap 222 of tack 220 and plate 230 of EAS tag 210. In the embodiment shown in FIG. 2, rim 234 around the perimeter of plate 230 fits into groove 240 on the top of EAS tag 210 to provide stability to plate 230.

Figure 2A:
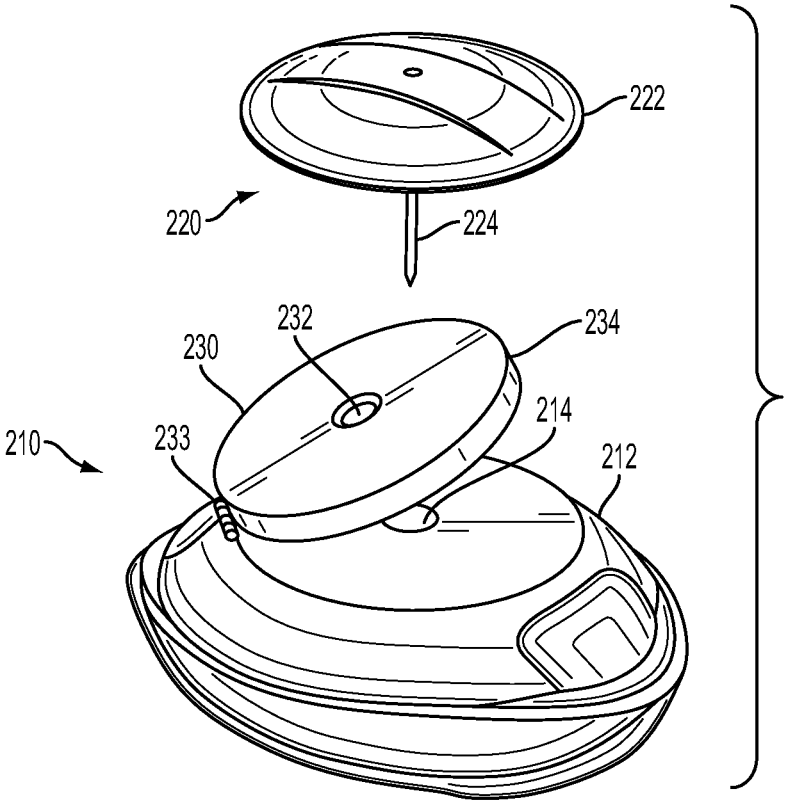
FIG. 2A is a perspective view of an EAS tag having an embodiment of a switch mechanism employing a plate, wherein the plate is shown to be attached to the body.

In some embodiments, the plate and the body may be attached to each other. Such an embodiment is shown in FIG. 2A. Plate 230 and body 212 of EAS tag 210 are detachably clamped together. In the embodiment shown, the clamping is achieved by employing a hinge 233. Other means of attachment may also be employed. Aperture 232 of plate 230 aligns with aperture 214 of body 212. When EAS tag 210 is assembled to an object to be protected by passing shaft 224 through the object and into aperture 214 of EAS tag 210, the object is captured between cap 222 of tack 220 and plate 230 of EAS tag 210.

Figure 3:
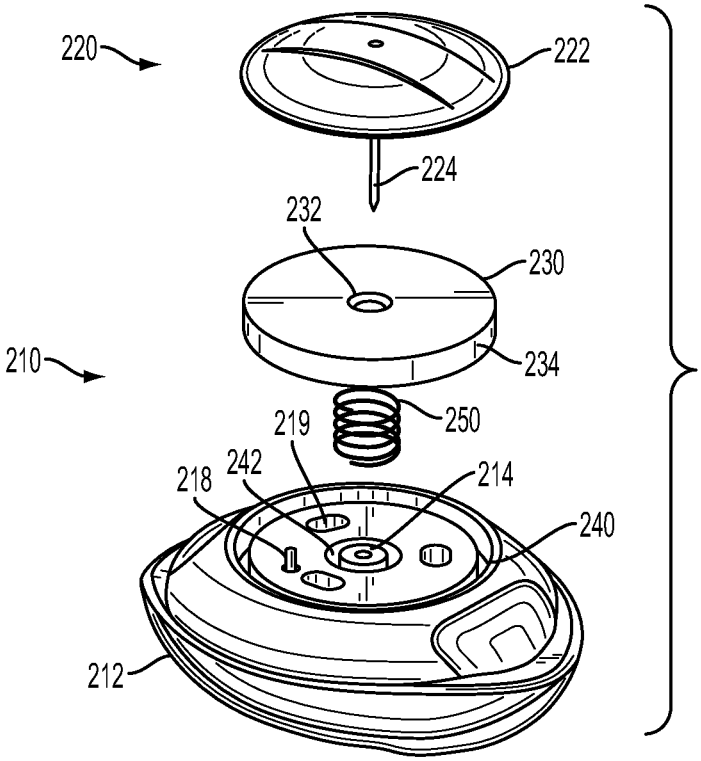
FIG. 3 is an exploded perspective view of the EAS tag of FIG. 2.

FIG. 3 is an exploded perspective view of the EAS tag of FIG. 2. Plate 230 is shown raised above EAS tag 210. Arming switch 218 may be seen protruding from the top surface of EAS tag 210. Spring 250 is located beneath plate 230 and is concentric with aperture 232 of plate 230 and aperture 214 of body 212 of EAS tag 210. Spring seat 242 in the top of body 212 provides a seat for spring 250. When body 212 of EAS tag 210 is not attached to an object, spring 250 prevents plate 230 from contacting arming switch 218 and changing its state. When EAS tag 210 is attached to an object, cap 222 of tack 220 presses the object down on plate 230 which then presses on arming switch 218, changing the state of arming switch 218 which effects the arming of EAS tag 210 much as discussed with respect to prior art EAS tag 10 shown in FIG. 1.

Figure 4:
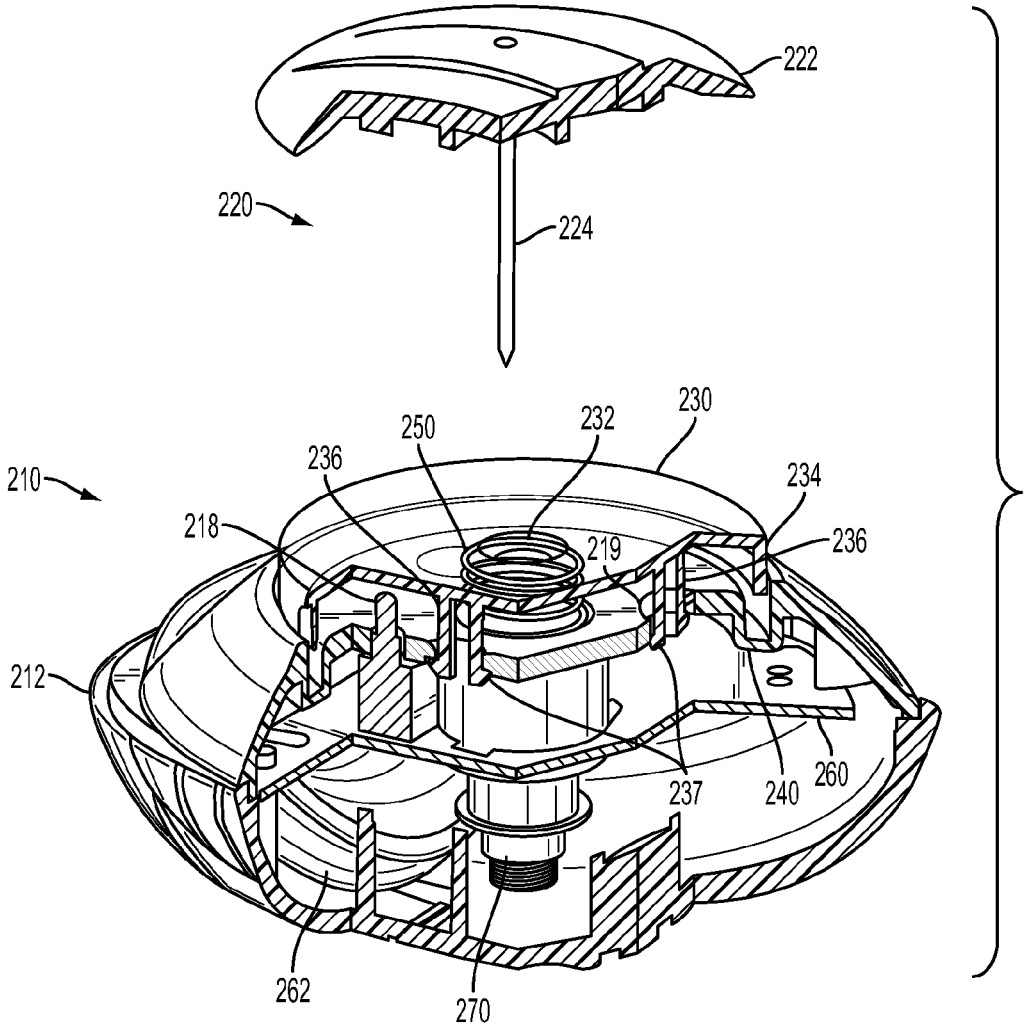
FIG. 4 is a sectioned perspective view of the EAS tag of FIG. 2.

FIG. 4 is a sectioned perspective view of the EAS tag of FIG. 2. In FIG. 4, the edge created by sectioning plate 230 is shown as a surface, while the rest of plate 230 is shown in outline. In FIG. 4, spring 250 is seated in spring seat 242 while rim 234 of plate 230 is inserted into groove 240. Plate 230 rests over arming switch 218. Plugs 236 extend from the bottom surface of plate 230 and insert into assembly apertures 219 in the top surface of body 212 of EAS tag 210. Plugs 236 have barbs 237 which engage the edges of assembly apertures 219 and maintain plate 230 in position on body 212 of EAS tag 210. Returning to FIG. 3, assembly apertures 219 may be seen in the top of EAS tag 210.

When shaft 224 is inserted through an object to be protected and aperture 232 and into aperture 214, cap 222 bears down onto the object which in turn bears down upon plate 230. This moves plate 230 down onto arming switch 218 which changes the state of arming switch 218. This either arms EAS tag 210 or is one of the steps for arming EAS tag 210. When EAS tag 210 is not assembled to an object to be protected, spring 250 pushes plate 230 away from the body of EAS tag 210, while barbs 237 on assembly plugs 236 maintain plate 230 in assembly to the body of EAS tag 210. This maintains plate 230 in a position that does not engage arming switch 218.

Other elements of EAS tag 210 are shown in FIG. 4. Circuit board 260 provides a mounting structure and electrical connections for electrical components, such as arming switch 218 and microprocessor 262. Other electrical components not visible in FIG. 4 include wireless communication elements such as a battery, wireless communication elements, audible alarm generator, etc. Also visible in FIG. 4 is clutch 270.

Figure 5:
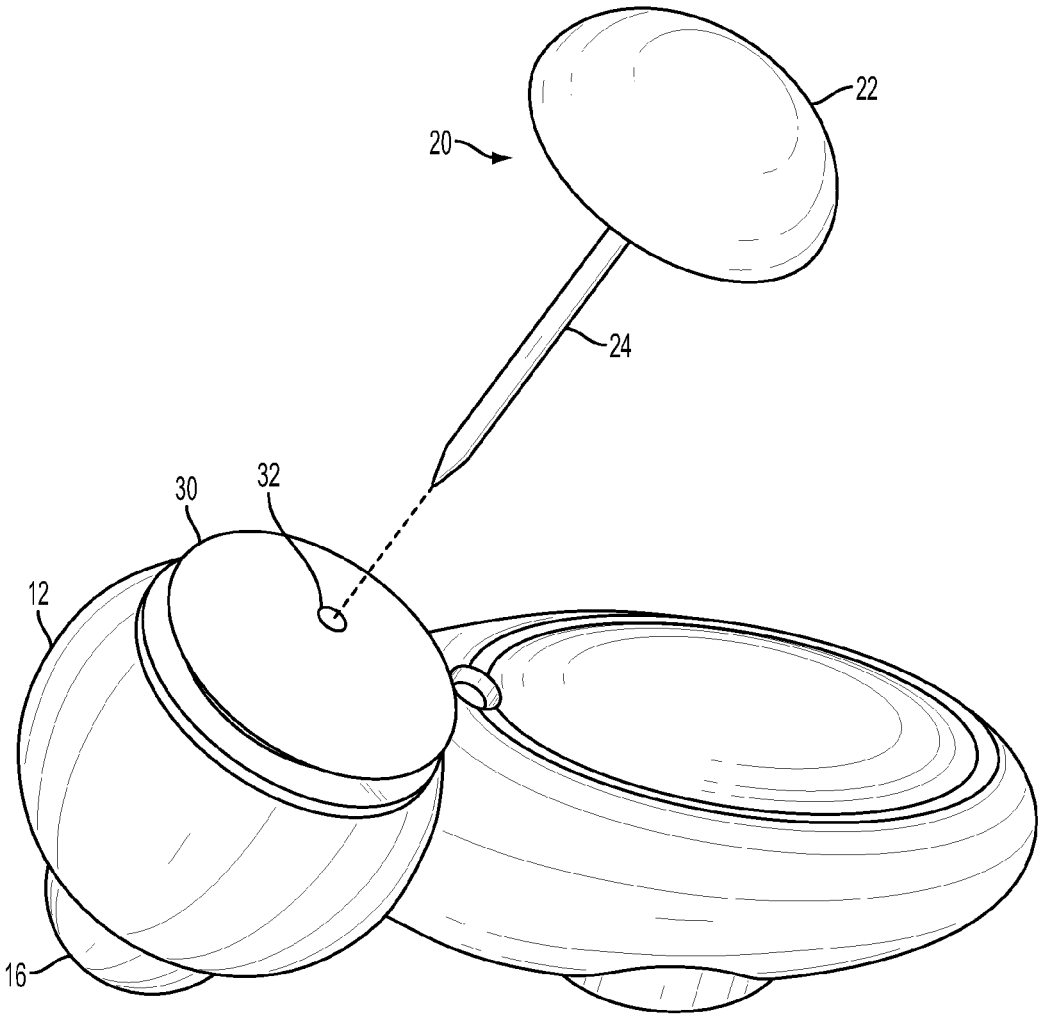
FIG. 5 is a perspective view of another embodiment of an EAS tag having an embodiment of a switch mechanism employing a plate.

FIG. 5 is a perspective view of the prior art tag of FIG. 1 having an embodiment of a switch mechanism employing a plate. Aperture 32 in plate 30 is concentric with aperture 14 in body 12 of EAS tag 510. Plate 30 is positioned over arming switch 18, effectively giving arming switch 18 a larger operating surface and avoiding the issues discussed with respect to prior art EAS tag 10 of FIG. 1. FIG. 5 illustrates the broad possibilities of the switch mechanism employing a plate.

Figure 6:
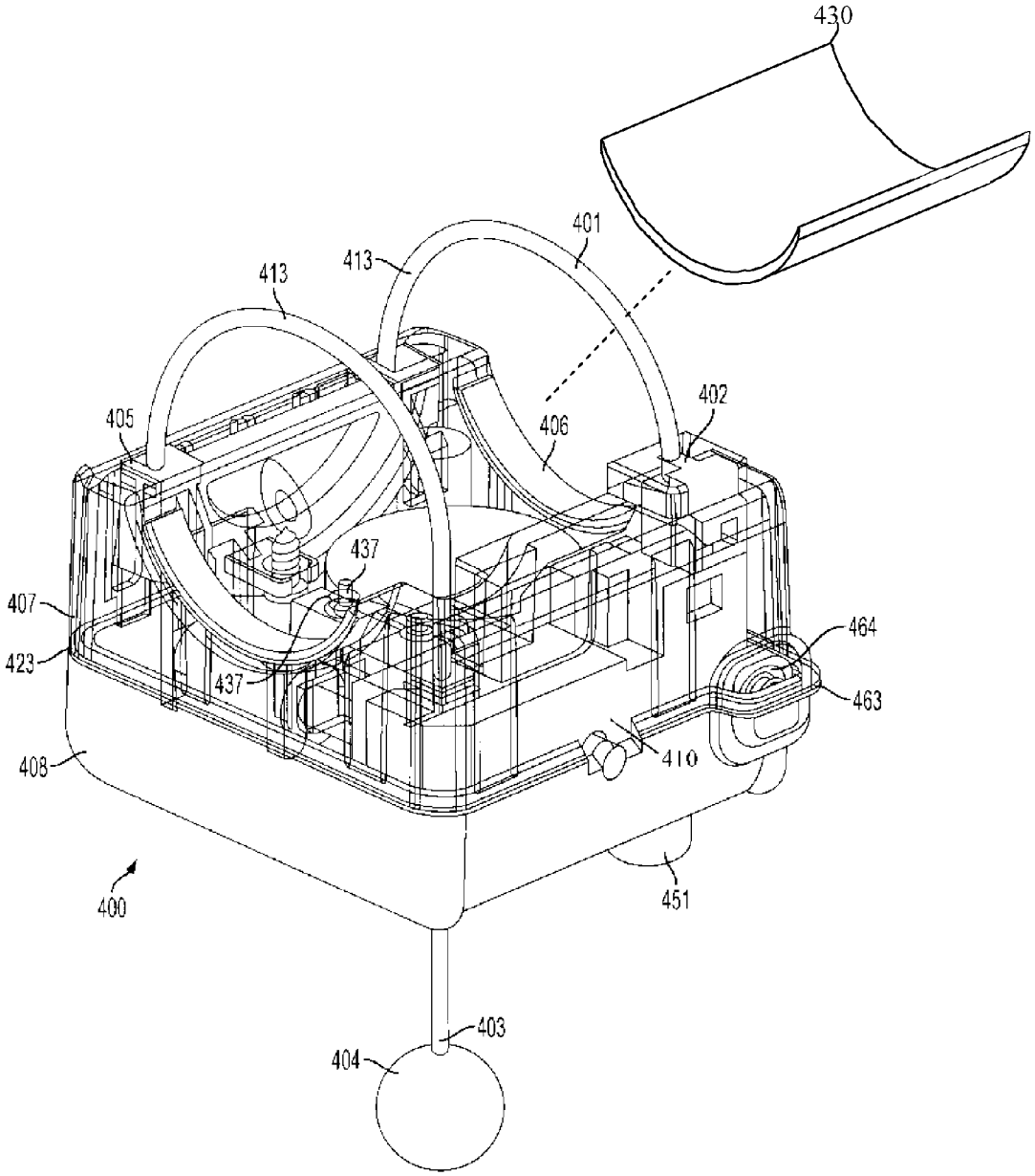
FIG. 6 is a perspective view of a prior art tag for irregular objects having an embodiment of a switch mechanism employing a plate.

Embodiments of the present invention can work with the several prior art embodiments of EAS tags employing arming switches. For instance, FIG. 6 is a perspective view of a prior art tag for irregular objects 400 with the retention part of the body shown in transparent in wireframe. EAS tag for irregular objects 400 has a retention cable 401 having a fixed end 402 and a free, adjustable end 403 with a pull knob 404 on the adjustable end 403. Retention cable 401 is anchored at fixed end 402 in mechanical housing 410 and passes through looping anchor 405 back to mechanical housing 410 to adjustable end 403 which is free. The outermost body of EAS tag for irregular objects 400 is comprised of two halves of a housing shell 423, a retention half 407 of housing shell 423 and an electronics half 408 of the housing shell 423. The retention half 407 of housing shell 423 of EAS tag for irregular objects 400 provides the structure and anchoring of mechanical housing 410 and looping anchor 405. The electronics half 408 of housing shell 423 of EAS tag for irregular objects 400 holds the electronic elements of EAS tag for irregular objects 400. If EAS tag for irregular objects 400 is removed from an object without authorization, as detected by arming switch 437, an alarm is generated to draw attention of an attendant. Arming switch 437 protrudes through an aperture in contact surface generally contiguous with cradles 406 of retention half 407 of shell 423. As may be seen in FIG. 6, the part of arming switch 437 that protrudes from the contact surface of tag 400 is relatively narrow. For certain items such as cloth items, it is possible that arming switch 437 may simply pass through the cloth. For example, arming switch 437 might simply pass through a sweater. Alternatively, arming switch 437 may be effective enough to allow tag 400 to be initially armed, but may later change its state with jostling of the object to which it is attached. Alternatively, the object may have a firm, but irregular surface. The irregular surface presents challenges similar to cloth in that switch may protrude into a void initially or later. This would lead to a false alarm which is a very undesirable result. A plate 430 may be positioned to intervene between the arming switch and the item to be protected. Plate 430 can be contoured to fit the expected shape of the item to be protected. Plate 430 can be further contoured to conform to the shape of cradles 406, as shown in FIG. 6. Plate 430 may be further designed like plate 230 to have plugs 236, as shown in FIG. 4. Once EAS tag for irregular objects 400 is attached to an object, arming switch 437 is depressed and remains depressed while EAS tag for irregular objects 400 is attached to the object and contact is maintained between the object and contact surface.

The releasable attaching mechanism in some embodiments of the present invention may further comprise a ball clutch mechanism as disclosed in U.S. Patent Application No. 2006/0070410 by Fuss and Yang. In this patent, the tag has a pair of hinged components that are detachably clamped together. In some embodiments of the present invention, we can detachably clamp the body and the plate, as described in FIG. 2A.

Embodiments of the present invention may be additionally coupled with a benefit denial ink based system. A frangible ink ampoule may be incorporated into the body. When the plate and body are forcibly separated to remove a protected article, the bending and pulling on the tag causes one or more ink ampoules to rupture, leaking a staining agent onto the protected article. Such ink-based systems are often used to protect clothing items. When such an article is stained with permanent dye, the potential thief is denied the benefit of the attempted theft. Such a benefit-denial system is disclosed in U.S. Patent Application No. 2010/0315238 by Yang. Additionally, such a benefit-denial system may be designed to seal the electronics package from the ampoule so as to prevent contamination of the electronics package by the staining agent released from the ampoule. Additionally, such a benefit-denial system may be designed to remove and replace the frangible ampoule, if ruptured. Furthermore, as disclosed in U.S. Patent Application No. 2010/0315238 by Yang, the benefit-denial system may be coupled with a ball clutch mechanism.

Although specific embodiments of the invention have been described with specificity, the embodiments described should not be considered exhaustive of the possible embodiments of the invention and should not be held as limiting the scope and range of the claims. Similarly the drawings are not exhaustive depictions of embodiments of the invention and the abstract is intended to allow a person to quickly gain the general field of the invention and should not be taken as limiting the scope of the claims.

While many novel features have been described above, the invention is not limited to these physical embodiments. It is described and illustrated with particularity so that that those skilled in the art may understand all other embodiments that may arise due to modifications, changes in the placement of the relative components, omissions and substitutions of this preferred embodiment that are still nonetheless within the scope of this invention.

I claim:

1. An electronic article surveillance tag comprising:

a tag body housing an electronics package within its interior, said electronics package comprising an arming switch extending to the exterior of said tag body;

a releasable attaching mechanism for attaching said tag body to an item to be protected;

a plate exterior to said tag body, said plate intervening between said item to be protected and said switch when said tag body is attached to an item to be protected;

said plate actuating said arming switch when said tag body is attached to an item to be protected.

2. The electronic surveillance tag of claim 1, wherein:

said attaching mechanism is releasable by application of an authorized detacher to said tag body.

3. The electronic surveillance tag of claim 2, wherein:

said detacher is magnetic.

4. The electronic surveillance tag of claim 1, wherein:

said releasable attaching mechanism comprises a cap and an elongated shaft extending from said cap.

5. The electronic surveillance tag of claim 4, wherein:

said shaft is in fixed angular orientation with respect to said cap.

6. The electronic surveillance tag of claim 1, wherein:

said electronics package comprises a battery and an audible alarm generator.

7. The electronic surveillance tag of claim 1, wherein:

said electronics package comprises a passive electronic surveillance element.

8. The electronic surveillance tag of claim 1, wherein:

said electronics package comprises a microprocessor.

9. The electronic surveillance tag of claim 1, wherein:

said electronics package comprises communication elements to communicate with a remote alarm generator.

10. The electronic surveillance tag of claim 1, wherein:

said attaching mechanism further comprises a releasable clutch mounted in said interior.

11. The electronic surveillance tag of claim 10, wherein:

said clutch is a ball clutch.

12. The electronic surveillance tag of claim 1, wherein:

said body further comprises a biasing mechanism to urge said plate away from said body.

13. The electronic surveillance tag of claim 12, wherein:

said biasing mechanism comprises of a spring seat on top of said body below said plate, and a spring seated on said spring seat.

14. The electronic surveillance tag of claim 1, wherein:

said plate further comprises at least one plug extending from said plate;

said body further comprises an assembly aperture on top of said body below said plate, to insertably receive said plug, and maintain said plate in assembly to said body.

15. The electronic surveillance tag of claim 1, wherein:

said body further comprises a frangible ampoule containing a staining agent integrated into said interior, said ampoule designed to fracture and spill said staining agent when said body and said plate are forced apart without the release of said attaching mechanism.

16. The electronic surveillance tag of claim 15, wherein:

said electronics package is sealed from said ampoule to prevent contamination of said electronics package by said staining agent when said ampoule is ruptured.

17. The electronic surveillance tag of claim 15, wherein:

said ampoule may be removed and replaced if broken.

18. The electronic surveillance tag of claim 1, wherein:

said plate comprises an external surface suitable for conforming to said item to be protected.

19. The electronic surveillance tag of claim 1, wherein:

said plate is shaped to conform to the shape of said body so as to properly actuate said arming switch.

20. The electronic surveillance tag of claim 1, wherein:

said plate and said body are detachably clamped together.

21. An electronic article surveillance tag comprising:

a tag body housing an electronics package, said electronics package comprising a detectable sensor and an arming switch;

a tack with a head and a shaft, oriented such that said shaft may be inserted into said tag body for releasably securing a protected item to said tag body;

a plate exterior to said tag body, said plate located to interpose between said tag body and both said protected item and said head;

said arming switch located on the surface of said tag body in a location such that said arming switch is depressed by said plate upon coupling of said tack and protected item to said tag body.

* * * * *